United States Patent [19]

Kihlstedt et al.

[11] 4,141,698

[45] Feb. 27, 1979

[54] METHOD OF CLEANING PARTICLE BEARING GAS

[75] Inventors: Per G. Kihlstedt, Bromma; Hedvig E. B. Hässler, Enskede, both of Sweden

[73] Assignee: Advanced Mineral Research AB, Stockholm, Sweden

[21] Appl. No.: 800,433

[22] Filed: May 25, 1977

[30] Foreign Application Priority Data

Jun. 1, 1976 [SE] Sweden ..... 7606162

[51] Int. Cl.[2] ..... B03C 3/16

[52] U.S. Cl. ..... 55/6; 55/10; 55/107; 55/124; 55/138

[58] Field of Search ..... 55/5–7, 55/10, 13, 107, 112, 121, 122, 124, 138; 239/3, 15; 361/227, 229

[56] References Cited

U.S. PATENT DOCUMENTS

| | | | |
|---|---|---|---|
| 1,331,225 | 2/1920 | Wolcott | 55/5 |
| 1,940,198 | 12/1933 | Wagner | 55/107 |
| 2,207,576 | 7/1940 | Brown | 55/10 |
| 2,357,354 | 9/1944 | Penney | 55/107 |
| 2,525,347 | 10/1950 | Gilman | 55/10 |
| 2,595,774 | 5/1952 | De Ment | 55/107 |
| 2,826,513 | 3/1958 | Blanchard | 239/3 |
| 2,858,900 | 11/1958 | Foley | 55/112 |
| 3,729,898 | 5/1973 | Richardson | 55/107 |

FOREIGN PATENT DOCUMENTS

| | | | |
|---|---|---|---|
| 214365 | 8/1967 | Sweden | 55/107 |
| 354199 | 3/1973 | Sweden | 55/107 |
| 23605 of | 1914 | United Kingdom | 55/107 |
| 400065 | 11/1974 | U.S.S.R. | 361/228 |

*Primary Examiner*—Frank W. Lutter
*Assistant Examiner*—David L. Lacey
*Attorney, Agent, or Firm*—Fleit & Jacobson

[57] ABSTRACT

Gas bearing particles is cleaned by bringing it together with a friction-electrically charged mist of water droplets, which is formed by the aid of an electrically conducting liquid mist generating nozzle to which water in liquid state which has been de-ionized to a conductivity of at most about $1 \times 10^{-5}$ $ohm^{-1}cm^{-1}$, is supplied. From this nozzle the charge of a polarity opposite to that of the mist is continuously conducted away.

12 Claims, 1 Drawing Figure

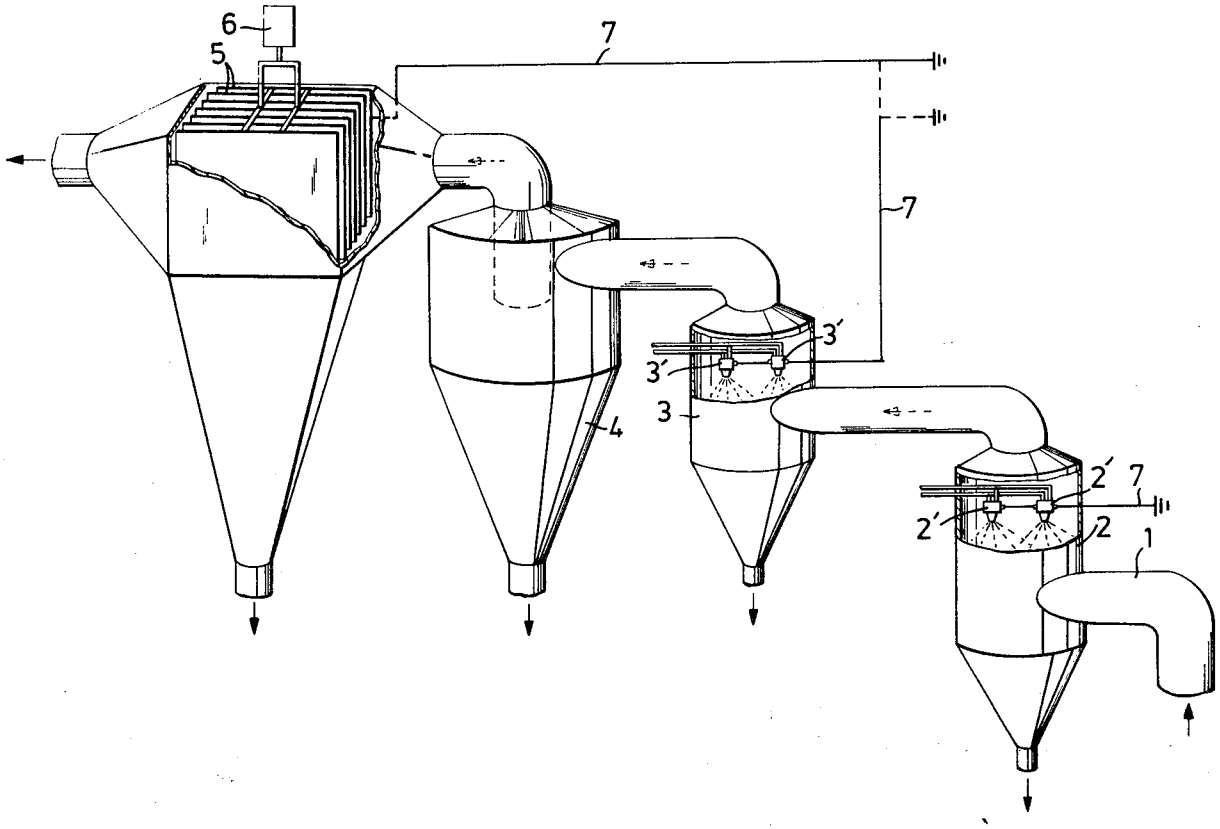
7
7
7
6
5
4
3
3'
3'
2'
2'
2
1

METHOD OF CLEANING PARTICLE BEARING GAS

The present invention relates to a method for cleaning gas bearing particles by bringing it together with friction-electrically charged water droplets.

Especially in industrial mineral technology, the primary source of ill-health and discontent would appear to be dust and dirt. This is of course bound up with basic general hygienic points of view, but above all with the illness-generating mineral dusts, such as reactive quartz and asbestos. The quartz dust most dangerous for the generation of silicosis appears to be that which is generated by shock impact crushing or blasting and which has a particle size of about 0.5–5 μm. This dust fraction is not entirely entrapped during breathing by the dust protecting mucous membranes of the body, but accompanies the air down into the lung tissues where it can be separated. Finer fractions i.e., those particles less than 0.5 micrometers are then contained within the air which is expired by the body.

The research work carried out in connection with the conception of the present invention has shown that the fraction in question in most cases has a majority of negative particle charges. Complete separation of the most dangerous dust would in general thus be promoted by using positively charged reception bodies during the dust separating process, quite particularly if also the more neutral or positively charged dust particles could be given a negative charge before separation; this latter line of thought is also applied in the design of conventional electrofilters.

Fundamental to all dust control, however is the principle of attacking the problem as close to its source as possible. This leads to methods of enclosure for avoiding spreading the dust. These methods of enclosure must however be combined with measures within the enclosed system for trapping and collecting dust. To an increasing extent, water spraying means have been applied for this purpose in the enclosed system. With water spraying of the kind known so far, the principle normally has been to transform dust from being an air contamination into a water contamination which can be removed.

The system used so far in spraying has substantial drawbacks. The droplets of water normally generated by the conventional nozzles are of the order of magnitude about 50 μm or larger. When such droplets are passed through dust-loaded air, the particles in the dangerous fraction range of about 0.5–5 μm, according to the above, will accompany the air round the droplets of water, since the mass of the individual particles is not sufficient to give them their own movement pattern. The drop size should therefore be reduced substantially thereby multiplying the surface per amount of water added. At the present time, this can be done best with ultrasonic nozzles.

Another disadvantage of the systems up to now is that the amounts of water which are introduced give an unsuitable consistency to the scrubbed-out dust and render its recovery more difficult, since the most advantageous recovery systems are conditional on dry or half-dry dust. Drying the dust causes expensive handling, both economically and in energy consumption. Spraying, above all with ultrasonic nozzles, has however greatly reduced the need for water in effective dust separation.

The object of the present invention is to further increase the effect of dust separation within the dangerous fraction by spraying and simultaneously reducing the amount of water accompanying the dust, while reducing the cost of purfication of such particle bearing gas by giving the droplets of water suitable electric charges in a simple way, so that they can easily attract dust from the dangerous fraction also, and so that the droplets of water themselves can easily be separated from the remaining gas.

It is already known to charge droplets of water with separately generated and supplied electricity to a certain charge strength and thereby affect dust particles in gas suspension with the aim of removing them. As examples, the Swedish Patent Specification Nos. 214,365 and 354,199 and the U.S. Pat. Nos. 2,357,354 and 3,729,898 can be mentioned. It has also been suggested to electrically charge liquid droplets by friction in conjunction with forming these droplets by use of spray nozzles. However, for this purpose there is used tap water alone or in combination with steam, i.e. substances having a relatively large conductivity, whereby the charges generated per amount of water are relatively small. As examples in this context the British Patent Specification No. 23,605/1913 and the U.S. Pat. No. 1,940,198 may be mentioned.

In accordance with the present invention a remarkable increase in magnitude of charge per unit of weight of water is obtained by a method, wherein water in liquid state and having a conductivity of at most about $1 \times 10^{-5}$ $ohm^{-1}cm^{-1}$ is charged electrically by friction and is converted to mist form by means of an electrically conducting liquid mist generating nozzle from which charge of a polarity opposite to that of the mist is continuously conducted away, whereupon the mist is brought together with the gas to separate the dust. Provided no additions are made to the water, there is obtained with this method a positively charged mist of water which has with only a low water flow rate, a sufficiently large amount of charge to effectively separate harmful particles, such as silicosis-generating dust, from gases bearing such particles.

Experiments of different kinds showed that the conductivity of the water should have been reduced to at most around $1 \times 10^{-5}ohm^{-1}cm^{-1}$ to give a good effect, preferably down to $1 \times 10^{-6}ohm^{-1}cm^{-1}$ or lower, which does not cause any substantial technical difficulties in present water purifying technology, e.g. can be obtained by the aid of unsophisiticated ion exchange equipment. From this value, the amount of charge per gram of sprayed water increases appreciably with reduced conductivity of the water. Amounts of charge of the order of magnitude of 25 times $10^{-7}$ Coulomb per gram water where achieved without difficulty, and these charging amounts must be considered very large. The droplet charges are in actual fact many powers of 10 greater than the charge of the dust particles in the aerosol typically produced e.g. in crushing mineral in a normal crushing plant. These particle charges, especially in the dangerous fraction, reduce the depositing ability of the dust and give rise to the often invisible dust suspensions which can be dangerous to breathe. The charges of water droplets introduced with nozzle generated mist of this kind are thus sufficient to give a heavy electrostatic effect on the dust suspension.

A specific advantage is provided by using as the mist generating nozzle an ultrasonic nozzle, i.e. where the water mist generation is accomplished by directing a jet of air or other gas against a resonator to produce an ultrasonic field in which de-ionized water also supplied through the nozzle is broken up into a mist comprising very minute droplets. Such ultrasonic nozzles are commercially available and are manufactured inter alia by Sonic Development Corp., New Jersey, USA, under the name SONICORE. Also other mist generating nozzles may be used which work with air or other gas as a medium for breaking up the water into a mist and produce a sufficient small droplet size. The average droplet size in the generated mist should be less than about 10 μm.

The charges arise in a friction-electrical way during the passage of the substantially non-conducting water through the earthed nozzle. From investigations of the transfer resistance to metals of water it has been established that the oxidation and absorption phenomena of the metal surfaces have a large effect on the current transfer between the water and the metal. Attempts with more inert and more easily conducting nozzle material gave as a result that gold-plated nozzles, for example, gave considerably higher drop charges in corresponding conditions than nozzles with surfaces of a less noble kind, of metal such as nozzles made from stainless steel. Consequently, there is used in an advantageous embodiment of the invention a mist generating nozzle, the water contacting walls of which are coated with a material such as gold or platinum, reducing the transfer resistance between water and the material of the nozzle.

The dust in the particle bearing gas together with the mist intermingled with said gas and consiting of charged water droplets can be separated in a simple manner by causing the gas to pass through at least one grid construction or the like, which is kept earthed or which has applied thereto a voltage of a polarity opposite to that of the mist. Suitably, the grid construction is provided with scrape-off or shake-off means for separating deposited dust bearing material. The said voltage can be applied to the grid construction by conductively connecting the mist generating nozzle to it. However, it is preferred and fully sufficient to keep both the grid construction and the mist generating nozzle connected to earth.

For preseparation of coarse particles and for furthering the contact between droplets and dust particles the dust-loaded gas and the mist of charged water droplets intermingled therewith may be passed through at least one cyclone or other dust separator working without an electrical field.

It is also possible to generate autogeneously, i.e. without any external source of electricity, negative charge instead of the positive charges discussed up to now, in the droplets of water broken up by the nozzle. These negative charges are relatively small, however. A suitable surfactant, usually in a very low concentration, is then added to the de-ionized low-conductive water. According to results obtained so far, the tenside should be cation-active and its concentration in the water can to advantage be as low as about 0.1 to 1 g per $m^3$. The negatively charged mist of water can be used for cleaning gas containing clay-holding dust or other mainly positively charged dust. Alternatively, generating a negatively charged mist of water may be used to supplement the charge of the dust particles, before intermingling the dust-loaded gas with positively charged water mist, by intermingling the gas with a negatively charged auxiliary charging mist obtained from a mist generating nozzle operating with substantially de-ionized water to which has been added a minor amount of preferably cationically active surface active agent.

BRIEF DESCRIPTION OF THE DRAWINGS

An embodiment of the invention is described below with reference to the accompanying drawing, which shows schematically an apparatus for cleaning dust-loaded gas.

DETAILED DESCRIPTION OF THE PREFERRED EMBODIMENT

A dust-loaded gas is introduced at 1 into a preparatory auxiliary chamber 2, in which the negative charge on the dust particles is supplemented as needed by spraying with negative water droplets, generated with de-ionized water which has been provided with a minor amount of surfactant. In the shown embodiment, the droplets are formed with ultrasonic nozzles 2', to which are connected conduits 2'' and 2''' for supplying pressurized air and water. Thereafter the dust-loaded gas is led into a main chamber 3, in which a positively charged water mist is generated from pure de-ionized water by means of one or a plurality of ultrasonic nozzles 3'; the pressurized air and water supply conduits are designated 3'' and 3'''. Thereafter the water misted gas passes through a chamber 4, suitably made as a cyclone, where a complete contact between dust and mist is achieved and a certain amount of the dust is separated. The exiting gas is thereafter caused to pass a grid construction 5 for separating charged dust. The grid construction is provided with shake-off or scrape-off means 6. Both nozzles and grid are provided with means 7 for conducting away voltage. Preferably, both nozzles and grid construction are earthed as shown, whereby positive electricity is taken to earth from the auxiliary nozzles 2' and grid construction 5, while negative electricity is taken to earth from the main nozzles 3'. The grid construction 5 and the main nozzles 3' can be connected to each other without earthing, whereby the grid construction is negatively charged by the main nozzles. Optionally, the grid construction can be supplied with a negative charge from an external voltage source.

In a half-scale apparatus, which in principle is similar to the apparatus shown on the drawing, particle bearing air was cleaned by means of an electrically charged water mist. The results were the following: Using ordinary tap-water and with only the main nozzle coupled in, a separation of the dust supplied with the air of about 85% was obtained through normal spraying with the ultrasonic nozzle. The dust-bearing water mist easily passed through the grid construction. When the same main nozzle was supplied with de-ionized water in the same way, still without coupling in the auxiliary nozzle, about 96% separation of supplied dust was obtained. The water mist and entrained dust then deposited itself mainly on the net grid construction, which did not allow the mist to pass. When a smaller auxiliary nozzle was later coupled in with surface active agent bearing water, an almost complete dust separation was obtained. It was found to be suitable to provide the grid construction with scraping means for recovering the deposited damp dust.

I claim:

1. A process for cleaning particle bearing gas by combining said gas together with friction-electrically charged water droplets, wherein water in liquid state and having a conductivity of at most about $1 \times 10^{-5}$ $ohm^{-1}cm^{-1}$ is charged electrically by friction and is converted to mist form by means of an electrically conducting liquid mist generating nozzle from which charge of a polarity opposite to that of the mist is continuously conducted away, whereupon the mist is combined with the gas to separate the dust.

2. A process as claimed in claim 1, wherein said water has a conductivity of the order of magnitude of $1 \times 10^{-6}$ $ohm^{-1}cm^{-1}$ or lower.

3. A process as claimed in claim 1, wherein said mist generating nozzle has water contacting walls coated with a material such as gold or platinum, thereby reducing the transfer resistance between water and the material of the nozzle.

4. A process as claimed in claim 1, wherein said mist generating nozzle employs an ultrasonic field to generate said water mist.

5. A process as claimed in claim 1, wherein the water is finely divided into said mist and having an average droplet size less than about 10 $\mu$m.

6. A process as claimed in claim 1, wherein the particles in the particle bearing gas which has been combined with the liquid mist are separated by causing the gas to pass through at least one grid costruction which is kept earthed or has applied thereto a voltage of a polarity opposite to that of the mist.

7. A process as claimed in claim 6, wherein said voltage is applied to the grid construction by conductingly connecting the mist generating nozzle to it.

8. A process as claimed in claim 6, wherein the grid construction is provided with scrape-off or shake-off means for separating deposited particle bearing material.

9. A process as claimed in claim 1, wherein the liquid mist generating nozzle is kept connected to earth.

10. A process as claimed in claim 1, wherein the particle bearing gas and the mist of charged water droplets intermingled therewith are passed through at least one non-electrical separator.

11. A process as claimed in claim 1, especially for treating gas containing clay-holding or other mainly positively charged dust, wherein said mist is a mist of negatively charged water droplets formed by adding a minor amount of preferably cationically active surfactant to the water before charging it.

12. A process as claimed in claim 1, wherein the charge of the particle bearing particles, before intermingling the particle bearing gas with the charged water mist, is supplemented by intermingling the gas with a negatively charged auxiliary charging mist obtained from a mist generating nozzle operating with substantially de-ionized water to which has been added a minor amount of cationically active surface active agent.

* * * * *